US009401060B2

(12) United States Patent
Cohrs et al.

(10) Patent No.: US 9,401,060 B2
(45) Date of Patent: Jul. 26, 2016

(54) DEVICE FOR DISPENSING COINS

(71) Applicant: Crane Payment Solutions GmbH, Buxtehude (DE)

(72) Inventors: Hans-Ulrich Cohrs, Horneburg (DE); Wilfried Meyer, Buxtehude (DE)

(73) Assignee: Crane Payment Solutions GmbH, Buxtehude (DE)

( * ) Notice: Subject to any disclaimer, the term of this patent is extended or adjusted under 35 U.S.C. 154(b) by 0 days.

(21) Appl. No.: 14/681,456

(22) Filed: Apr. 8, 2015

(65) Prior Publication Data

US 2015/0294520 A1 Oct. 15, 2015

(30) Foreign Application Priority Data

Apr. 9, 2014 (DE) ..... 10 2014 105 032

(51) Int. Cl.
*G07D 1/00* (2006.01)
*G07D 9/00* (2006.01)

(52) U.S. Cl.
CPC .. *G07D 1/00* (2013.01); *G07D 9/00* (2013.01); *G07D 9/008* (2013.01)

(58) Field of Classification Search
CPC ..... G07D 1/00; G07D 3/00
USPC ..... 453/58, 49, 57
See application file for complete search history.

(56) References Cited

U.S. PATENT DOCUMENTS 3,187,760 A * 6/1965 Simjian ..... G07D 1/04 221/11
5,046,989 A * 9/1991 Dass ..... G07D 1/00 194/344
5,066,262 A * 11/1991 Abe ..... G07D 9/008 221/182
5,516,293 A * 5/1996 Heidel ..... G07D 9/008 250/214 B
2010/0072024 A1* 3/2010 O'Byrne ..... G07D 3/128 194/302

* cited by examiner

*Primary Examiner* — Mark Beauchaine

(57) ABSTRACT

A device for dispensing coins includes a rotatingly-driven rotary disk, a coin container arranged above the rotary disk, through which coins are fed to a top side of the rotary disk, and a coin discharge. A wiper device is also includes and comprises at least one elastic wiper arm arranged above and at a distance from the top side of the rotary disk and turning with the rotary disk.

20 Claims, 3 Drawing Sheets

DEVICE FOR DISPENSING COINS

CROSS-REFERENCE TO RELATED APPLICATION

This application claims priority to German application no. 10 2014 105 032.0, filed Apr. 9, 2014, which is incorporated herein in its entirety by reference.

TECHNICAL FIELD

This disclosure relates generally to a device for dispensing coins.

BACKGROUND

So-called hoppers or coin payout units generally have a base plate on which a rotary disk rotatingly driven by means of a drive motor is located. Coins are given to the top side of the rotary disk via a coin intake, which are then picked up by the rotation of the rotary disk and delivered to a coin discharge. A coin container, in which coins are stored to be paid out to customers, is located above the rotary disk. From the coin container, the coins reach the top side of the rotary disk. The rotary disk can be arranged with its rotational axis diagonal to the vertical direction. The rotary disk then takes the coins reaching the top side of the rotary disk from the coin container to the coin discharge. An ejector knife may be arranged in the area of the coin discharge, which delivers coins from the top side of the rotary disk to the coin discharge connecting to the outer edge of the rotary disk in the area of a lateral recess. Moreover, the coin discharge frequently comprises, for example, a spring-pretensioned ejector device, which is deflected against its spring pretensioning by a coin delivered into the coin discharge. The coin, in the course of its subsequent movement back to the idle position, is accelerated in the direction of an outlet route. From the outlet route, the coins reach a dispenser to a customer.

In the operation of such hoppers, critical coins can lead to malfunctions or at least problems. This includes the jamming of individual coins or the accumulation of coins in the coin container in the area of the transfer to the top side of the rotary disk. The coins then cannot be picked up properly or completely by the rotary disk and thus delivered to the coin discharge. It is decisive that all coins, including the last coin, are delivered to the coin discharge. Moreover, undesired roll formations of the coins reaching the rotary disk can also lead to hollow space or bridge formations. The aforementioned problems occur individually or also in combination with each other and namely both during the process of similar types of coins as well as during the processing of different coins.

SUMMARY

It has been suggested to provide pins or the like protruding laterally into the rotating area of the rotary disk in order to release coin accumulation. However, such an arrangement cannot always reliably eliminate the problems explained above, in particular coin accumulations. Moreover, jams can lead to impermissibly high forces and thus damage to the pin or other components. In order to reduce occurring forces, a pin would need to protrude, tilted in the rotational direction, into the rotating area of the rotary disk. However, in such a case, the operation of the hopper is of course only possible in one rotational direction.

It would be desirable to provide a device for dispensing coins that securely avoids the malfunctions described above without risk of damage for components of the device and with the greatest flexibility in terms of operation.

For such a device, a wiper device may be included where the wiper device comprises at least one elastic wiper arm arranged above and at a distance from the top side of the rotary disk and turning with the rotary disk.

As already explained, the device can be a so-called coin hopper or respectively a coin payout unit. The device has a rotary disk mounted in a rotating manner, for example on a base plate. The rotary disk is rotatingly driven by a suitable drive, for example an electric drive motor. The drive of the rotary disk can be part of the device according to some implementations of the invention. From the coin container arranged above the rotary disk, coins in a transfer area are supplied to the top side of the rotary disk. The coins are picked up from this transfer area by the rotary movement of the rotary disk and delivered in this manner to the coin discharge.

In the area of the coin discharge, an ejector device can be provided. The ejector device may be pivotably mounted so as to be deflected from its idle position against a spring pretensioning by the coins delivered into the coin discharge and accelerate the coins during their subsequent movement back to their idle position in the direction of an outlet route or the like. Via the outlet route, the coins can be paid out, for example to a customer. A fixed ejector knife, under which the rotary disk turns, can be located above the rotary disk next to the coin discharge. The ejector knife delivers coins from the rotary disk to the coin discharge. The ejector knife is thereby in particular designed such that it delivers respectively just one coin to the coin discharge and delivers additional coins potentially stacked on this coin via a ramp of the ejector knife back into the transfer area of the coins coming from the coin container.

According to the teachings herein, a wiper device with at least one elastic wiper arm is provided. The elastic wiper arm is located above and slightly distanced from the top side of the rotary disk. When the rotary disk turns, the at least one elastic wiper arm is also turned. The at least one elastic wiper arm clears coin accumulations on the top side of the rotary disk, in particular in the transfer area of the coins coming from the coin container, like a stirrer. In particular, it also clears roll formations of coins standing on their edge and places these coins on their sides. During the rotation of the at least one elastic wiper arm by the coin volume located on the top side of the rotary disk, the at least one elastic wiper arm is deformed elastically. The individual coins that are left behind, for example in the area of an ejector knife or in the transfer area of the coin container, are also delivered on by the at least one flexible wiper arm and thus also reach the coin discharge.

According to this description, it is thus ensured that the so-called last coin is also supplied from the rotary disk to the coin discharge. The elasticity of the at least one wiper arm represents an alternative to the wiper arm so that clump formations of coins can also be securely cleared without a rotation of the at least one elastic wiper arm and thus of the rotary disk becoming too stiff, as would be the case with a rigid stir pin. The joint rotation of the at least one elastic wiper arm with the rotary disk ensures that coins not conveyed along by the rotary disk are supplied back to the delivery by the rotary disk and are thus directed to the coin discharge. Only through the combination of an elastic wiper arm with the joint rotation with the rotary disk are all of the potential malfunctions explained above securely avoided without risk of damage to the components of the device.

The rotary disc can be designed circularly or annularly. Accordingly, it has a center or an inner edge. It also has an outer edge. The at least one elastic wiper arm thereby extends at least in sections between a center or an inner edge and an outer edge of the rotary disk. In particular, the at least one elastic wiper arm can extend mainly completely between the center or respectively the inner edge and the outer edge of the rotary disk.

Furthermore, the at least one elastic wiper arm can extend in the radial direction to the rotary disk. The at least one elastic wiper arm can extend in sections or completely radially to the rotary disk. Each arm can also extend in sections or entirely at an angle to the radial direction. The at least one elastic wiper arm can also have a curved progression.

The at least one elastic wiper arm can be made for example of a plastic or a rubber material. The use of metal components may be undesirable in this context. The required elasticity can be provided in a particularly simple and cost-effective manner through the use of a plastic or a rubber material. Elastomers, in particular thermoplastic elastomers, come into consideration as plastics, for example. But other plastics are also possible. For example, polyurethane, in particular a thermoplastic polyurethane (TPU), is conceivable. The at least one elastic wiper arm can have a Shore hardness between 70 and 95, for example approximately 90. The wiper arm or respectively the wiper arms of the wiper device can have for example a width of 2 to 9 mm and a height of 2 to 9 mm. Furthermore, the width can be lower than the height. For example, the width can be 2 to 4 mm, in particular 3 mm, and the height 5 to 7 mm, in particular 6 mm. These dimensions naturally depend on the individual application and among other things also the used material of the wiper arm or respectively of the wiper arms and the elasticity of such material.

According to a further design, a bearing section of the wiper device can be mounted on an axial section of the rotary disk driven by a rotary drive and the at least one elastic wiper arm can be connected with one end with the bearing section. The axial section is for example connected with an electric drive motor that rotates the axial section and thus the rotary disk. When the rotary disk rotates, the at least one elastic wiper arm is then also rotated over the axial section and the bearing section. According to a particularly practical design, the bearing section of the wiper device can have a bore hole into which the axial section of the rotary disk is inserted. The axial section then sits in the bore hole of the bearing section, which can be in particular a perforation, so that the bearing section is designed annularly. A notch, into which the annular bearing section is inserted, can be provided on the axial section. The entire wiper device can be formed integrally. The wiper arm(s) can thus be connected integrally with the bearing section. The bearing section then interconnects the ends of the wiper arms. But, it is also possible that the bearing section is designed separately from the wiper arms.

According to a further design, the axial section of the rotary disk may be inserted in a pressing manner into the bore hole of the bearing section of the wiper device such that a rotation of the axial section in the bore hole is not possible in the case of a rotation of the rotary disk up to a limit torque, and a rotation of the axial section in the bore hole is possible when the limit torque is exceeded. A press fit between the axial section and the bore hole is thus provided, which permits a slipping of the axial section in the bore hole as of a defined limit torque. Similar to a slipping clutch, the torque-proof connection between the bearing section and the axial section is removed as of a defined limit torque, and the rotary disk can rotate further without the at least one elastic wiper arm being jointly rotated.

Through the suitable design of the fit between the axial section, in particular its diameter, and the bore hole in the bearing section of the wiper device, the limit torque and thus the friction occurring during operation and the mixing of the coins can be set in a suitable manner. If large accumulations of coins are located on the rotary disk or respectively in the coin container, then the wiper device slips through on the axial section because of the occurrence of high torques. If, on the other hand, only a few coins are located on the rotary disk, then the at least one elastic wiper arm rotates with the rotary disk and clears roll or bridge formations and coin jams or respectively delivers all coins to the coin discharge. Both the drive motor as well as the wiper device, in particular the wiper arm(s), are protected from damage by the decoupling of the rotation of rotary disk and wiper device permitted in particular in the case of a coin container filled with a lot of coins. The limit torque is advantageously adjusted so that a slipping of the axial section in the bore hole of the bearing section only takes place when the elasticity of the wiper arms no longer suffices for the clearing of the respective coin accumulations. This can be determined within the framework of calibration of the device.

According to a further embodiment, an end section enlarged in the cross-section is formed on the free end of the at least one elastic wiper arm. Such an end thickening hooks in the coin accumulations in the course of the rotation of the at least one elastic wiper arm, similar to a wiper arm curved on the end, and thus leads to an improved clearing of the coin accumulations. The at least one elastic wiper arm (and thus also any provided thickening on the free end) can be designed symmetrically in relation to its longitudinal axis. In a particularly advantageous manner, operation of the device in both rotational directions of the rotary disk is then possible without needing to change the wiper device.

The wiper device can have at least two elastic wiper arms arranged above and at a distance from the top side of the rotary disk. This is particularly advantageous for a good intermixing of the coins and for clearing coin accumulations. The wiper arms then stir the coin volume, similar to a propeller. If two or even more than two wiper arms are provided, all of these wiper arms can be designed as explained as described in the above example for the at least one elastic wiper arm. Thus, all wiper arms of the wiper device can be designed identically. Furthermore, the at least two elastic wiper arms can be offset with respect to each other by 180° in the rotational direction of the rotary disk. The wiper arms are thus arranged opposite each other with respect to the center of the rotary disk. This results in a particularly even operation, but is not required.

According to a further embodiment, driving pins jointly rotating with the rotary disk can be designed on the top side of the rotary disk. The driving pins protrude from the top side of the rotary disk and pick up the coins supplied from the coin container to the top side of the rotary disk during a rotation of the rotary disk. If an ejector knife is provided, the driving pins can be retracted, for example via a coulisse, before reaching the ejector knife so that the driving pins no longer protrude over the top side of the rotary disk and a collision with the ejector knife is avoided.

It is also possible that pockets are provided on the top side of the rotary disk, wherein the pockets are designed to move coins located on the rotary disk to the driving pins. The pockets in the rotational direction of the rotary disk may have a different angular distance than the at least two elastic wiper arms. Such pockets can act for example on coins uprising on their edge such that the coins lie with their sides on the rotary disk. The pockets in the running surfaces push, as it were, coins such that they are picked up by the driving pins of the rotary disk. It sometimes thereby happens that coins slip right between two neighboring pockets in the rotational direction of the rotary disk and are thus not delivered on properly. The at least one elastic wiper arm further delivers such coins. For this, it is particularly advantageous if the angle division of the wiper arms (for example 180° to each other) is different than the angle division of the pockets to each other. Through these different angle distances seen in the rotational direction of the rotary disk between the wiper arms on one hand and between the pockets on the other hand, it is ensured that coins located between neighboring pockets are picked up by the wiper arms.

According to a further design, the rotational axis of the rotary disk can progress diagonal to the vertical direction, for example at an angle between 20° and 70°, more preferably between 30° and 60°. As a rule, the transfer area of the coins reaching the top side of the rotary disk from the coin container then lies in the area passed through the deepest by the rotary disk during operation of the device.

BRIEF DESCRIPTION OF THE DRAWINGS

Embodiments of the invention are explained in greater detail below with reference to the figures, in which.

If not otherwise specified, the same reference numbers indicate the same objects in the figures.

DETAILED DESCRIPTION

Figure 1:
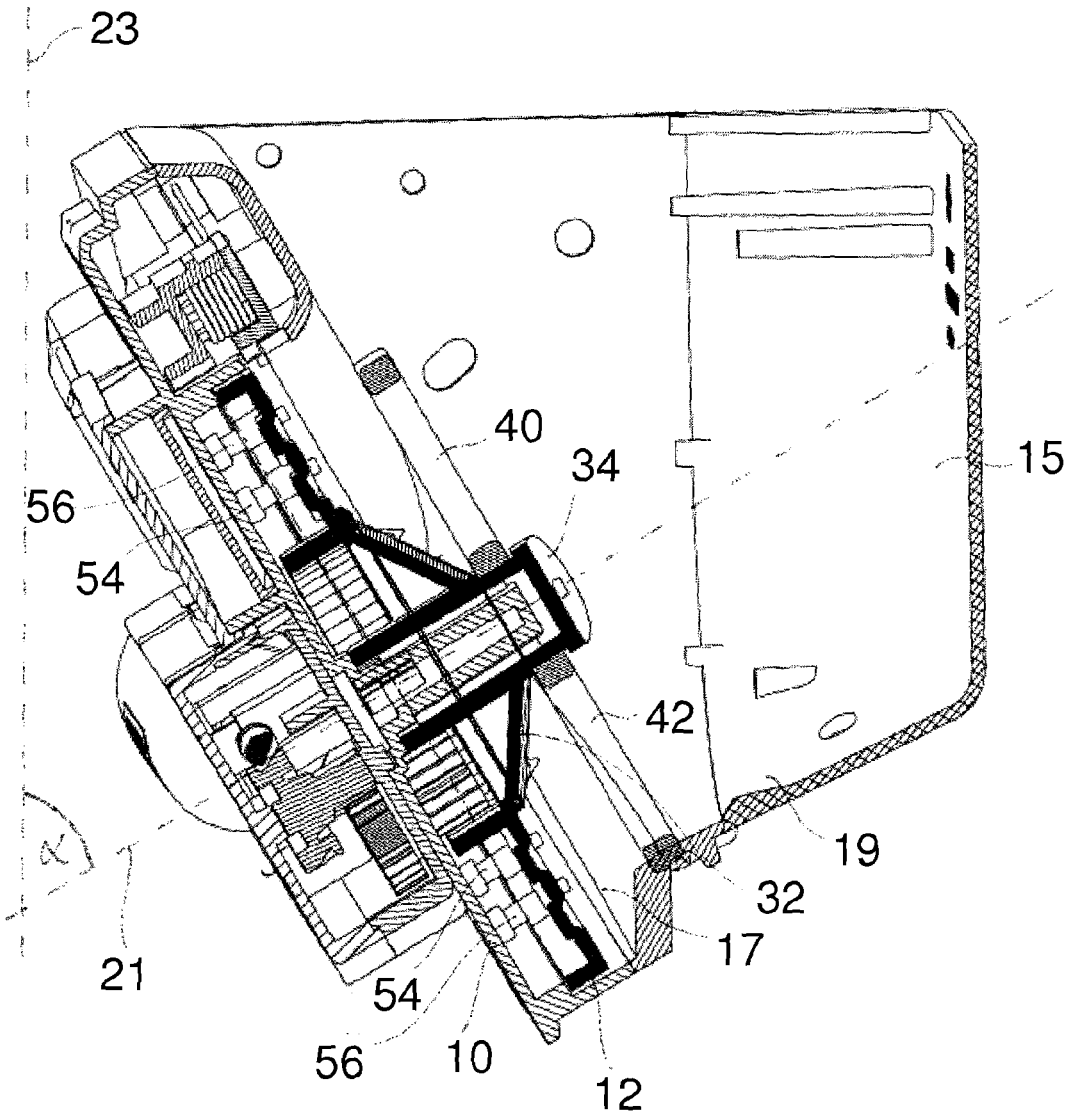
FIG. 1 is a sectional view of a device according to one example of the invention.
Figure 2:
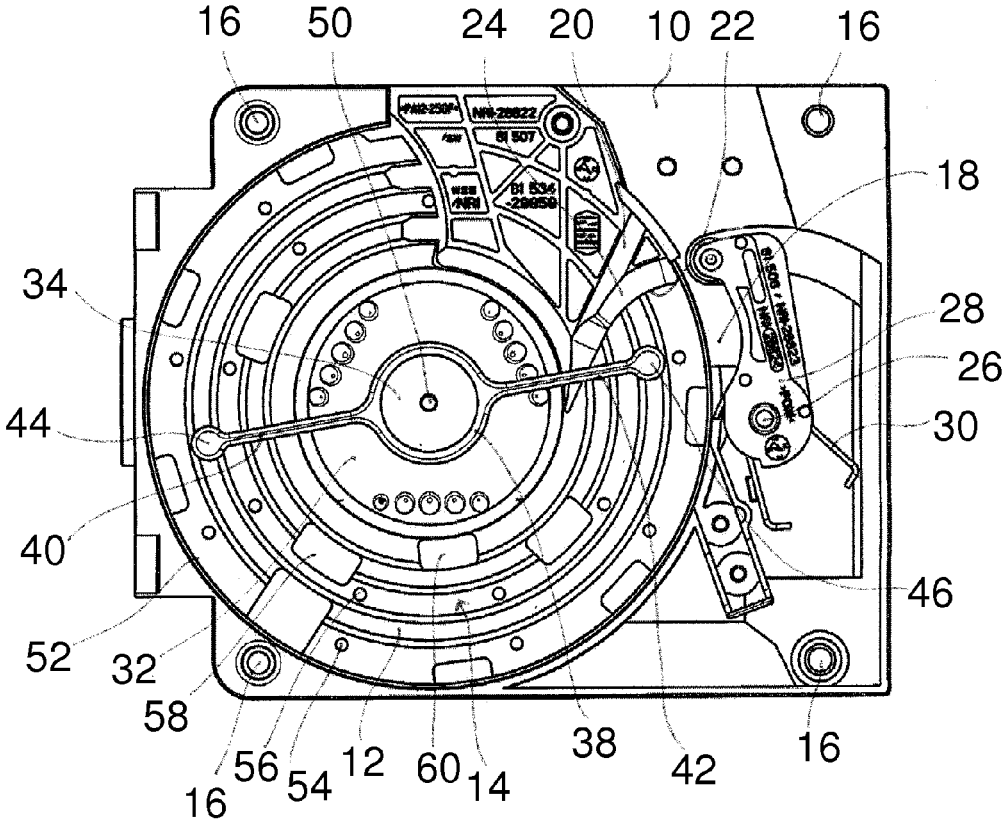
FIG. 2 is a top view of a portion of the device of FIG. 1.
Figure 3:
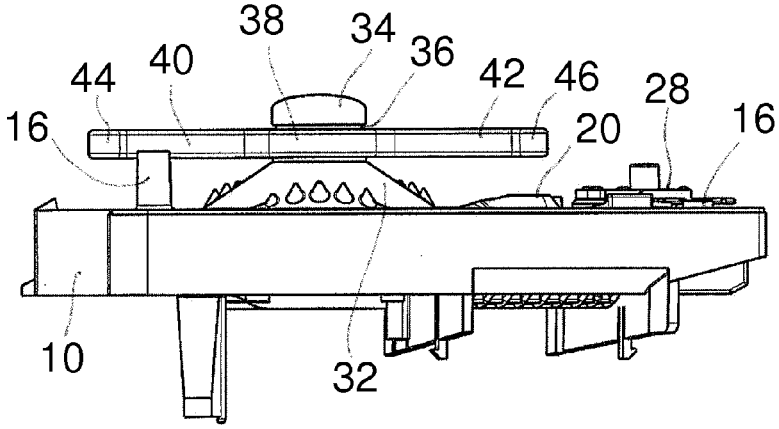
FIG. 3 is a side view of the portion shown in FIG. 2.

The device shown in FIGS. 1 to 3 for dispensing coins for a so-called coin hopper has a base plate 10 on which a rotary disk 12 rotatingly driven by means of a drive is arranged. The drive may be an electric drive motor. The rotary disk 12 in FIG. 2 is rotated counter-clockwise. In the shown example, the rotary disk 12 is circular and has an annular top side 14. A coin container 15 (shown only in FIG. 1) provides coins to a transfer area 17, from which the coins reach the top side 14 of the rotary disk 12. For this, the coin container 15 has a coin supply hopper 19. A coin dispensing device (not shown in greater detail) on the bottom side can be connected with the base plate 10 via four fastenings 16 shown in the example.

As can be seen in particular in FIG. 1, the rotary axis 21 of the rotary disk 12 progresses at an angle $\alpha$ diagonal to the vertical direction shown by line 23. From the top side 14 of the rotary disk 12, coins are supplied to a coin discharge 18. A fixed ejector knife 20, under which the rotary disk 12 turns, is arranged above the rotary disk 12 next to the coin discharge 18. The ejector knife 20 separates coins by means of a crescent-shaped stop 22, and the rotary disk 12 delivers the individual coins below the ejector knife 20 to the coin discharge 18. The stop 22 is thereby designed such that respectively only one coin at a time reaches the coin discharge 18. Additional coins potentially stacked on that coin are delivered over a ramp-like section 24 of the ejector knife 20 via the ejector knife 20 and back to the transfer area 17 of the coin container 15.

Moreover, an ejector device 28 pivotably mounted around a pivot axis 26 is located in the area of the coin discharge 18. The ejector device 28 is pre-tensioned by means of a spring 30 in the idle position shown in FIG. 2. If the ejector knife 20 delivers a coin to the coin discharge 18 and against the ejector device 28, the ejector device 28 pivots against the spring 30, pre-tensioning of the spring 30 around the pivot axis 26 in a clockwise direction in FIG. 2. As soon as the coin has reached the free end of the ejector device 28, the ejector device 28 pivots back to its idle position by the spring 30, wherein the coin of an outlet route (not shown in greater detail) is supplied in an accelerated manner. From the outlet route, the coins can be supplied to an exit for the storage or the paying out of the coins to a customer.

Figure 4:
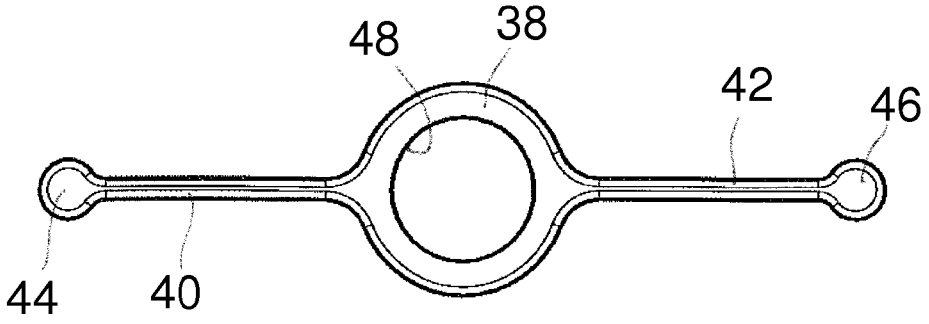
FIG. 4 is a top view of a wiper device of the device of FIG. 2.

The rotary disk 12 has a central, truncated conical section 32 with a central axial section 34. An annular notch 36, in which an annular bearing section 38 of a wiper device having a perforation 48 is held in this example, is designed on the axial section 34. In the shown example, the wiper device comprises two elastic wiper arms 40, 42. It can be seen that the elastic wiper arms 40, 42 are located above the top side 14 of the rotary disk 12 and at a distance from it. The clearing of the coin accumulations can be impacted in a targeted manner through selection of a suitable distance. The elastic wiper arms 40, 42 are connected respectively integrally with the bearing section 38, and each has on its other, free end a respective end section 44, 46 with a thickened cross-section. The structure of the wiper arms 40, 42 is easy to see in the enlarged representation in FIG. 4. The through hole or perforation 48 of the bearing section 38 can also be seen there. As seen for example in FIG. 2, the elastic wiper arms 40, 42 extend in their idle position in the radial direction to the rotary disk 12 and respectively in sections between the center 50 of the rotary disk 12 and the outer edge 52 of the rotary disk 12.

In this example, the wiper device is designed completely integrally and is made of a plastic, for example a thermoplastic polyurethane with a Shore hardness of 90. The central bearing section 38 sits with its perforation 48 pressing in the annular notch 36 on the axial section 34 such that the wiper device and with it the elastic wiper arms 40, 42 are jointly rotated during rotation of the rotary disk 12 until a limit torque is reached. If this limit torque is exceeded, the axial section 34 in the perforation 48 slips through so that the rotary disk 12 rotates without the wiper device. During operation, the elastic wiper arms 40, 42, if applicable under elastic deformation of the wiper arms 40, 42, clear any coin accumulations, coin jams, etc., on the top side 14 of the rotary disk 12, in particular in the transfer area 17 of the coin container 15. They stir, as it were, coin volumes located on the rotary disk 12. It is ensured in this manner that undesired coin accumulations are cleared and any coin located on the rotary disk 12 is delivered to the coin discharge 18.

Moreover, it can be seen in FIG. 2 that a plurality of driving pins 54, 56 arranged along two circuits with different diameters are located on the top side 14 of the rotary disk 12. The driving pins 54, 56 protrude over the top side 14 of the rotary disk 12 and are retracted by means of a coulisse in the area of the ejector knife 20 so that there is no collision with the ejector knife 20. The driving pins 54, 56 pick up coins located on the top side 14 of the rotary disk 12 during operation. Moreover, it can be seen in FIG. 2 that a plurality of pockets 58, 60 are also designed on the top side 14 of the rotary disk 12. The pockets 58, 60 deliver coins to the area of the driving pins 54, 56. The pockets 58, 60 are thereby arranged with respect to each other at a different angle distance as seen in the rotational direction of the rotary disk 12 than the elastic wiper arms 40, 42, which are distanced from each other by 180° in this example. Other spacings are possible as long as the pockets 58, 60 are arranged at with different angle distances therebetween than those between the elastic wiper arms 40, 42 and are not aligned with any arm 40, 42.

What is claimed is:

1. A device for dispensing coins, comprising:

a rotatingly driven rotary disk having a top side;

a coin container arranged above the rotary disk, through which coins can be fed to the top side of the rotary disk;

a coin discharge; and a wiper device that includes at least one elastic wiper arm arranged between the coin container and the rotary disk, and above and at a distance from the top side of the rotary disk and turning with the rotary disk.

2. The device according to claim 1, wherein the at least one elastic wiper arm extends at least in sections between a center or an inner edge and an outer edge of the rotary disk.

3. The device according to claim 1, wherein the at least one elastic wiper arm extends in a radial direction with respect to the rotary disk.

4. The device according to claim 1, wherein the at least one elastic wiper arm is made of at least one of a plastic material or a rubber material.

5. The device according to claim 1, wherein the wiper device includes a bearing section mounted on an axial section of the rotary disk, the rotary disk is driven by a rotary drive, and the at least one elastic wiper arm is connected with one end with the bearing section.

6. The device according to claim 5, wherein the bearing section of the wiper device has a bore hole into which the axial section of the rotary disk is inserted.

7. The device according to claim 6, wherein the axial section of the rotary disk is inserted in a pressing manner into the bore hole of the bearing section of the wiper device such that a rotation of the axial section in the bore hole is not possible in the case of a rotation of the rotary disk up to a limit torque, and a rotation of the axial section in the bore hole is possible when the limit torque is exceeded.

8. The device according to claim 1, wherein a free end of the at least one elastic wiper arm opposite from the one end connected with the bearing section includes an end section with an enlarged cross-section.

9. The device according to claim 1, wherein the at least one elastic wiper arm is symmetrical with respect to its longitudinal axis.

10. The device according to claim 1, the at least one elastic wiper arm comprises at least two elastic wiper arms arranged above and distanced from the top side of the rotary disk.

11. The device according to claim 10, wherein the at least two elastic wiper arms are arranged offset by 180° with respect to each other in a rotational direction of the rotary disk.

12. The device according to claim 1, wherein the rotary disk includes driving pins located on the top side of the rotary disk that pick up the coins supplied from the coin container to the top side of the rotary disk during a rotation of the rotary disk.

13. The device according to claim 12, wherein the at least one elastic wiper arm comprises at least two elastic wiper arms arranged above and distanced from the top side of the rotary disk; and wherein the rotary disk includes pockets on the top side of the rotary disk, the pockets designed to move coins located on the rotary disk radially on the rotary disk to the driving pins and the pockets in a rotational direction of the rotary disk having a different angular distance to each other than the at least two elastic wiper arms.

14. The device according claim 1, further comprising:

a fixed ejector knife arranged next to the coin discharge above the rotary disk and under which the rotary disk rotates, wherein the ejector knife delivers separated coins from the rotary disk into the coin discharge.

15. The device according to claim 1, wherein a rotary axis of the rotary disk progresses diagonal to a vertical direction.

16. The device according to claim 1, further comprising:

an outlet route connects to the coin discharge, through which the coins delivered by the rotary disk are supplied to an outlet.

17. The device according to claim 1, wherein the at least one elastic wiper arm extends at least in sections between a center or an inner edge and an outer edge of the rotary disk.

18. The device according to claim 1, wherein the at least one elastic wiper arm extends in a radial direction with respect to the rotary disk.

19. The device according to claim 1, wherein the at least one elastic wiper arm is made of at least one of a plastic material or a rubber material.

20. A coin hopper for dispensing coins, comprising:

a rotatingly driven rotary disk having a top side;

a coin container arranged above the rotary disk, through which coins can be fed to the top side of the rotary disk; and a wiper device that includes at least one elastic wiper arm arranged between the coin container and the rotary disk, and turning with the rotary disk.

* * * * *